United States Patent [19]

Sanchez

[11] 4,066,180

[45] Jan. 3, 1978

[54] FRANGIBLE CAP FOR BOTTLES

[76] Inventor: Alejandro C. Sanchez, 1531 N. Fuller, Hollywood, Calif. 90046

[21] Appl. No.: 748,747

[22] Filed: Dec. 9, 1976

[51] Int. Cl.[2] ..... B65D 41/52

[52] U.S. Cl. ..... 215/254; 215/317

[58] Field of Search ..... 215/253, 254, 256, 317, 215/319, 321, 316; 206/515

[56] References Cited

U.S. PATENT DOCUMENTS

| | | | |
|---|---|---|---|
| 1,477,139 | 12/1923 | Lucas | 215/321 |
| 2,808,168 | 10/1957 | Majer | 215/316 |
| 2,934,232 | 4/1960 | Pesch | 215/321 |
| 3,326,401 | 6/1967 | De Long | 215/316 X |
| 3,866,783 | 2/1975 | Bullock | 215/254 |

FOREIGN PATENT DOCUMENTS

| | | | |
|---|---|---|---|
| 313,218 | 6/1929 | United Kingdom | 215/254 |

*Primary Examiner*—Donald F. Norton
*Attorney, Agent, or Firm*—William W. Haefliger

[57] ABSTRACT

A frangible sealing cap for a bottle neck comprises:

a. a plastic cup having a top cover and a depending annular skirt, the cover and skirt having thin walls, the skirt being free of annularly outward bulge structure, b. a plastic pull tab integral with the skirt and depending to a level below the lowermost level of the skirt, and c. there being two weakening score lines extending into, but incompletely through the skirt from the outer surface thereof, said lines extending upwardly toward the top cover from points proximate the junctures of the skirt with opposite edges of the tab.

9 Claims, 7 Drawing Figures

FRANGIBLE CAP FOR BOTTLES

BACKGROUND OF THE INVENTION

This invention relates generally to bottle caps, and more particularly concerns frangible plastic caps adapted to sealingly fit over five gallon water bottles; however, the caps are also useful for closure of other type bottle necks.

A prior plastic cap is described in detail in U.S. Pat. No. 3,392,862 to Faulstich. That cap is characterized by certain disadvantages among which are: excessive wall thickness necessary to its construction, but which is wasteful of expensive plastic material; the need for an outward annular protrusion which prevents nested stacking of the caps; inability to effectively seal bottle necks of configuration different from that shown in the patent; and difficulty with rupturing of the cap to enable its rapid removal.

SUMMARY OF THE INVENTION

It is a basic object of the invention to provide a bottle cap overcoming the above mentioned, as well as other disadvantages associated with prior caps. Basically, the novel cap incorporating the invention comprises:

a. a plastic cup having a top cover and a depending annular skirt, the cover and skirt having thin walls, the skirt being free of annularly outward bulge structure, b. a plastic pull tab integral with the skirt and depending to a level below the lowermost level of the skirt, and c. there being two weakening score lines extending into, but incompletely through the skirt from the outer surface thereof, said lines extending upwardly toward the top cover from points proximate the junctures of the skirt with opposite edges of the tab.

As will be seen, the cover may typically define an annular, upwardly protruding bulge which enables radial stretching of the cover during assembly onto a bottle neck; the skirt is straight walled and slightly frusto-conical to enable nested stacking; the cap wall thickness is between 0.010 and 0.030 to save plastic material, and its density may be controlled between limits to facilitate its assembly onto different bottle necks without altering wall thickness, thereby achieving economy of manufacture and wide range of application to different bottle necks; scoring of the skirt is in axial direction to facilitate upward tearing by means of a pull tab, the absence of a radial or sideward bulge on the skirt favoring upward tearing to desired extent to rapidly free the cap from the bottle neck; and the cap is especially useful in cooperation with a plastic or glass water bottle neck of the bulging character shown in the drawings.

These and other objects and advantages of the invention, as well as the details of an illustrative embodiment, will be more fully understood from the following description and drawings, in which:

DRAWING DESCRIPTION

DETAILED DESCRIPTION

Figure 1:
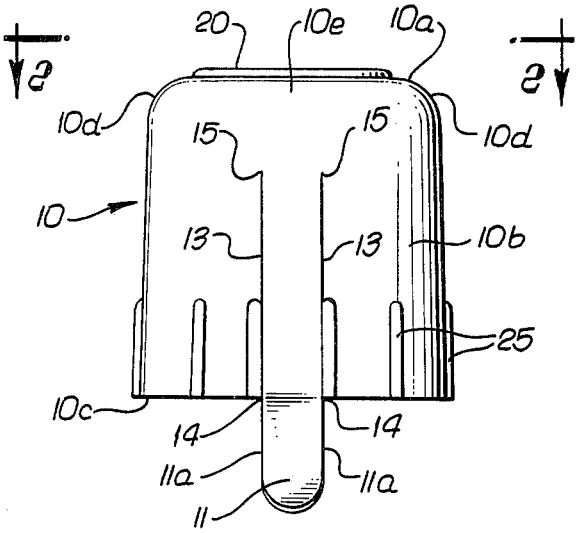
FIG. 1 is a side elevation of a cap.
Figure 2:
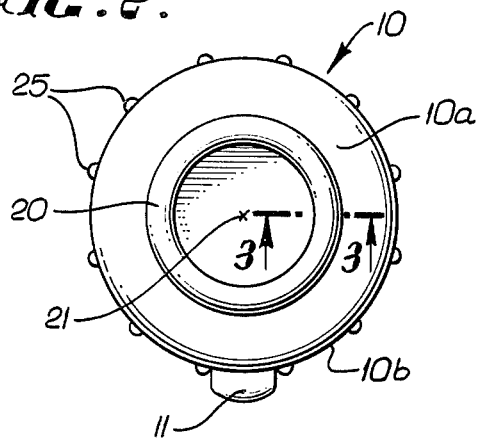
FIG. 2 is a top plan view of lines 2—2 of FIG. 1.

In the drawings, the frangible sealing cap for a bottle neck comprises a plastic cup 10 having a top cover **10*a* and a depending annular skirt 10*b*. The cover and skirt have thin walls to save material cost, and have the same thickness which is between about 0.010 and 0.030 inches. Preferably, the plastic consists of polyethylene having a density between about 0.910 and 0.965 as respects both the cover and skirt. In the molded condition, as seen in FIGS. 1 and 2, the skirt is free of outward bulge structure, whereby the cups are fully stackable in nested condition as viewed in FIG. 6**, to minimize shopping and storage space. Also, the skirt is slightly frusto-conical, i.e. it tapers axially toward the cover.

The cap includes a plastic pull tab integral with the skirt and depending therefrom to a level below the lowermost level of the skirt. For example, the pull tab 11 is shown as integral with the skirt in FIG. 1, above bottom skirt level **10*c*. The tab may have a wall thickness the same as that of the skirt, and may have elongated striations or ribbing at its underside. See for example the exposed striations 12 in FIG. 5**, which enable a good grip to be had when pulling the tab upwardly to tear the skirt.

Figure 5:
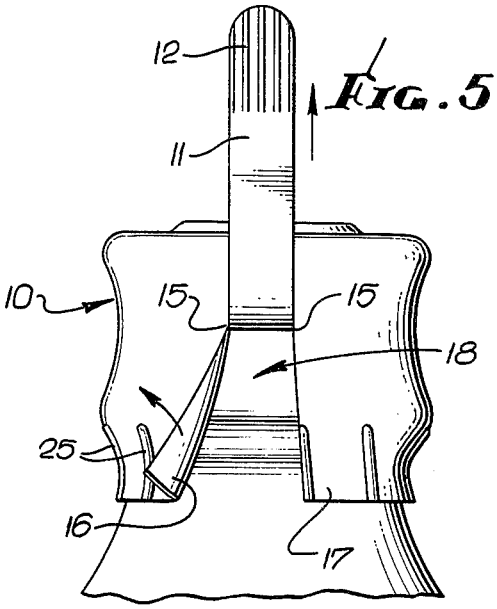
FIG. 5 is a side elevation showing tearing of the cap.

There are two weakening score lines 13 extending into, but incompletely through, the skirt from the surface thereof. Lines 13 extend upwardly as shown toward the top cover from points 14 at or proximate the junctures of the skirt edge **10*c* with opposite side edges 11*a* of the pull tab. The tab may be turned up and pulled upwardly as shown in FIG. 5 to tear the skirt along lines 13 and to the upper limits 15, leaving the skirt flaps 16 and 17 free to be peeled back (as illustrated by flap 16) enabling the cap to be easily removed off a bottle neck 18. Limits 15 are below the level of the uppermost portions 10*d* of the skirt. This provides a skirt upper extent 10*e* which remains unruptured, for re-sealing placement over the bottle neck upper extent 18*a*** after initial removal of the cap off the neck.

Figure 3:
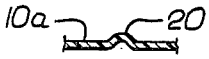
FIG. 3 is a section on lines 3—3 of FIG. 2.

The cover **10*a* defines an annular, upwardly protruding bulge 20 which is coaxial with the skirt axis 21. Bulge 20 is spaced inwardly from radially outermost portion 10*a* of the cover which are outwardly convex and merge downwardly with uppermost portions 10*d* of the skirt, as best seen in FIG. 1. The annular bulge 20 imparts a resiliently yieldable radial stretchability factor to the cover, allowing it to stretch and better conform to the top of the bottle neck as the skirt is urged downwardly over the periphery of the neck in a somewhat sealingly stretched condition, both axially and circumferentially. Note the radially lengthened extent of the bulge in FIG. 4, as compared with the undeformed bulge section in FIG. 3**.

Figure 7:
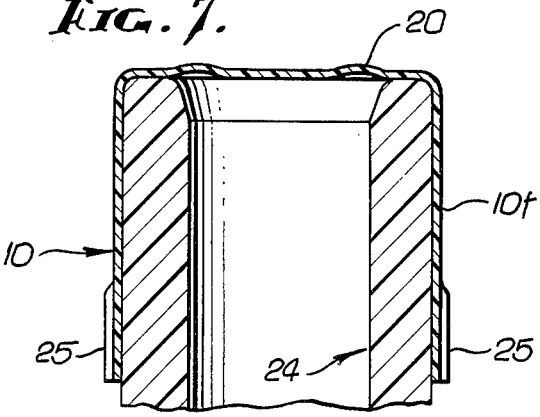
FIG. 7 is a side elevation showing application to a modified bottle neck.
Figure 4:
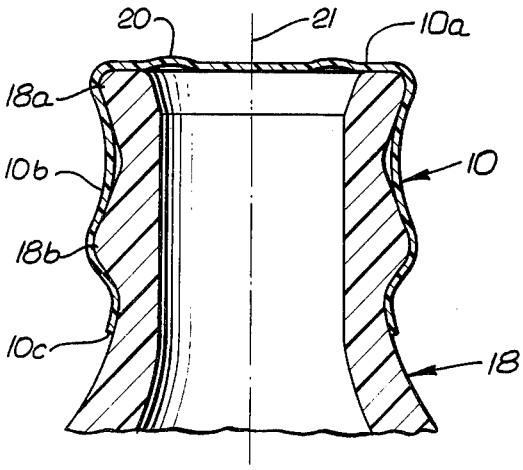
FIG. 4 is a vertical section.
Figure 6:
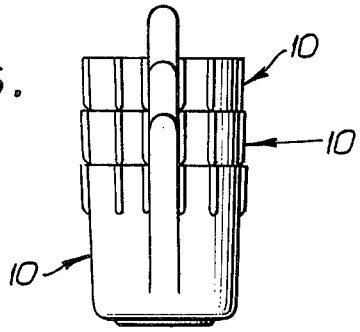
FIG. 6 is a vertical elevation showing nested stacking of caps.

Further, the fact that the bulge 20 is located on the cover enables the skirt to be straight, i.e. free of a sideward bulge, the thin walled skirt readily conforming to the bottle neck shape as seen in FIG. 4, with upper and lower annular protrusions **18*a* and 18*b*. Since there is no sideward bulge in the skirt in as-molded condition, caps are fully stackable as previously described and as seen in FIG. 6. Note that axial radial planes define intersections with the skirt which are in the form of straight lengths or lines. Such lengths appear at 10*f* in FIG. 7, wherein the skirt is fitted over a straight side-walled bottle neck 24**.

Finally, the skirt is thickened at circularly spaced locations to define narrow reinforcing protrusions 25 which are elongated in directions toward the top cover. The protrusions stand outwardly from the outer side of the skirt along the lower half thereof. Two of such protrusions extend adjacent the score lines 13. Lines 13 typically have a depth which is about one-half the skirt wall thickness.

I claim:

1. A frangible sealing cap for a bottle neck, comprising:

a. a plastic cup having a top cover and a depending annular skirt, the cover and skirt having thin walls, the skirt being free of annularly outward bulge structure, said skirt and cover each having wall thickness between about 0.010 and 0.030 inches, b. a plastic pull tab integral with the skirt and depending to a level below the lowermost level of the skirt, and c. there being two weakening score lines extending into, but incompletely through the skirt from the outer surface thereof, said lines extending upwardly toward the top cover from points proximate the junctures of the skirt with opposite edges of the tab, d. the skirt being thickened at circularly spaced locations to define narrow reinforcing protrusions which are elongated in directions toward the top cover and which stand outwardly from the outerside of the skirt, the protrusions confined to the lower half of the skirt, said score lines located adjacent two of said protrusions but at the inner sides thereof closest the main extent of the tab, whereby the skirt material between the score lines is uninterrupted by any of said protrusions.

2. The cap of claim 1 wherein said cover defines an annular, upwardly protruding bulge spaced inwardly from radially outermost portions of the cover which are outwardly convex and merge downwardly with uppermost portions of the skirt.

3. The cap of claim 1 which consists of molded polyethylene, and the circular spacing between successive pairs of all said protrusions is about equal to the width of said tab.

4. The cap of claim 1 which consists of molded polyethylene having a density between about 0.910 and 0.965.

5. The cap of claim 1 wherein said skirt is frusto-conical, tapering toward the top cover, whereby multiple of said caps are fully and freely stackable in nesting relation.

6. The cap of claim 1 wherein the cap defines a central axis and axial radial planes define intersections with the skirt which are in the form of straight lengths.

7. The combination that includes a bottle having a neck over which said cap of claim 1 is stretchably and sealingly applied.

8. The combination of claim 7 wherein said neck is straight.

9. The combination of claim 7 wherein said neck defines a local circular bulge spaced below the top of the neck and over which said cap is sealingly stretched, the protrusions located below the level of said bulge.

* * * * *